United States Patent [19]

Stengel et al.

[11] 4,194,728

[45] Mar. 25, 1980

[54] APPARATUS FOR THE INDUCTIVE HARDENING BY QUENCHING OF BEARING SURFACES OF A CRANKSHAFT

[75] Inventors: Edgar Stengel, Remscheid; Friedhelm Emde, Hückeswagen, both of Fed. Rep. of Germany

[73] Assignee: Aeg-Elotherm G.m.b.H., Fed. Rep. of Germany

[21] Appl. No.: 887,416

[22] Filed: Mar. 15, 1978

[30] Foreign Application Priority Data

Mar. 22, 1977 [DE] Fed. Rep. of Germany ..... 2712455

[51] Int. Cl.[2] ..... C21D 1/66

[52] U.S. Cl. ..... 266/125; 219/10.57; 266/129

[58] Field of Search ..... 266/129, 125; 219/10.43, 10.57, 10.67, 10.69, 10.71, 10.73

[56] References Cited

U.S. PATENT DOCUMENTS

| | | | |
|---|---|---|---|
| 2,315,509 | 4/1943 | Denneen et al. | 219/10.71 |
| 3,174,738 | 3/1965 | Seulen et al. | 219/10.57 |
| 3,383,100 | 5/1968 | Balzer et al. | 266/129 |
| 3,854,707 | 12/1974 | Armstrong et al. | 266/129 |
| 3,970,813 | 7/1976 | Day | 266/129 |

*Primary Examiner*—John McQuade

*Attorney, Agent, or Firm*—Cushman, Darby & Cushman

[57] ABSTRACT

An apparatus for inductively hardening by quenching of the running surface of bearings of a crankshaft in which the crankshafts are transported by a lifter-conveyor system to a clamp which grips the crankshaft and is pivoted about a lever arm pivotably mounted on the machine frame to a heating position below a plurality of inductors. The inductors ride on the crankshaft as it rotates to inductively heat the running surfaces. The inductors are each mounted on a linkage which also mounts a quenching shower and the linkage in turn is swingably mounted on a further lever arm which is pivotably connected to the machine frame. As the crankshaft rotates, the inductor lifts and the further lever arm lifts off a stop. The apparatus preferably includes a second clamp and set of inductors to which the crankshaft is subsequently conveyed for further treatment after hardening.

6 Claims, 2 Drawing Figures

APPARATUS FOR THE INDUCTIVE HARDENING BY QUENCHING OF BEARING SURFACES OF A CRANKSHAFT

The invention relates to an apparatus for the inductive hardening by quenching of the running surface of a lifting bearing of a crankshaft.

Machines are known with a clamping arrangement disposed in a machine frame for the rotatable mounting of the crankshaft around a horizontal rotational axis, and, disposed above the clamping arrangement, a movable mounted inductor feedable with an electric AC current and being capable of being arranged in a heating position on the running surface of the bearing to inductively heat the running surface of the bearing. Such machines include a shower arrangement connected with the bearing arrangement of the inductor for the feeding in of a fluid coolant for quenching the heated running surface of the bearing in which case the inductor arrangement is swingably mounted to be movable in two directions transversely to the axis of rotation of the clamping arrangement in such a way, that upon rotation of the eccentric lifting bearing of the crankshaft, the inductor rotates on the lifting bearing surface. A conveying arrangement is provided below the clamping arrangement for the horizontally lying feeding-in of the crankshaft into a clamping position in which the shaft may be clamped into the clamping-in arrangement.

In known machines of this type, the crankshaft is moved into its starting position for hardening by a lifter-conveyor, is received in this starting position between dead centers of a pair of spindles and is lifted and clamped down at the same time. The inductor arrangement disposed above this clamping arrangement is then lowered to the surface of the lifting surface of the crankshaft. In case of a rotating crankshaft, the inductor is lifted and swung, and the lifting bearing is heated inductively. Finally, after the heating, the bearing is quenched by spraying on a quenching liquid to form martensite. Such arrangements have the disadvantage that the shaft must be lifted by a special development of the clamping arrangement, from the lifter-conveyor and the inductor arrangement in order for it to be lowered, must be movably mounted on a separate carriage in a vertically running direction. As a result, a relatively precise positioning of the crankshaft in the clamping-in position and an extremely long lifting path of the inductor arrangement become necessary, as a result of which not only the constructional height of the machine must be enlarged, but also the flexible electric feed lines for the medium frequency electric AC current to the inductor or pertinent construction units must be disadvantageously lengthened.

The present invention deals with an improvement of machines of this type so that the movability of the inductor arrangement transverse to the rotational axis of the crankshaft is limited to a short distance, determined by the reach or the lift of the lifting bearing in the crankshaft, in addition to its possible thermal changes of position. The flexible electric feed lines to the inductor may therefore correspondingly be shortened and the degree of effectiveness of the arrangements improved. At the same time, the costs of the bearings for the inductors can be reduced and the function of the machine simplified.

According to this invention, the clamping arrangement is disposed on the machine frame on a lever arm swingable around a rotational axis between a clamping in position disposed in the path of transportation of the transportation arrangement and a heating position below the inductor. This development has the advantage that the crankshaft which is to be processed by means of the machine may be moved by means of the transportation arrangement into a locally fixed clamping down position, may be clamped down there by means of a clamping arrangement, may be brought by rotation about a horizontal axis into a position predetermined by the position of the inductor and may be transferred into a working position by lifting of the clamping arrangement in which working position the inductor arrangement rests on the bearing surface of the lifting bearing in a low lying position of said lifting bearing. Upon rotation of the crankshaft around its longitudinal axis, the inductor arrangement need only to be lifted by a distance which corresponds to the distance required to clear the lifting bearing of the crankshaft.

Thus, a conventional transportation arrangement can be used. Furthermore, the arrangement may be made in such a way that the machine frame for the mounting of two arrangements disposed on the path of the transportation arrangement, has arrangements for the inductive heating and subsequent quenching of running surfaces of the bearing of the crankshaft, of which one arrangement serves for the hardening of the lifting bearings and the other arrangement for the hardening of the main bearings of the shaft. In the hardening station for the main bearings of the shaft, the movability of the inductor in regard to height now needs to be still adapted to the maximum heat delay of the crankshaft, as a result of which the electric flexible feed lines may be kept particularly short.

The attached drawings serve for the explanation of the preferred embodiment.

Figure 1:
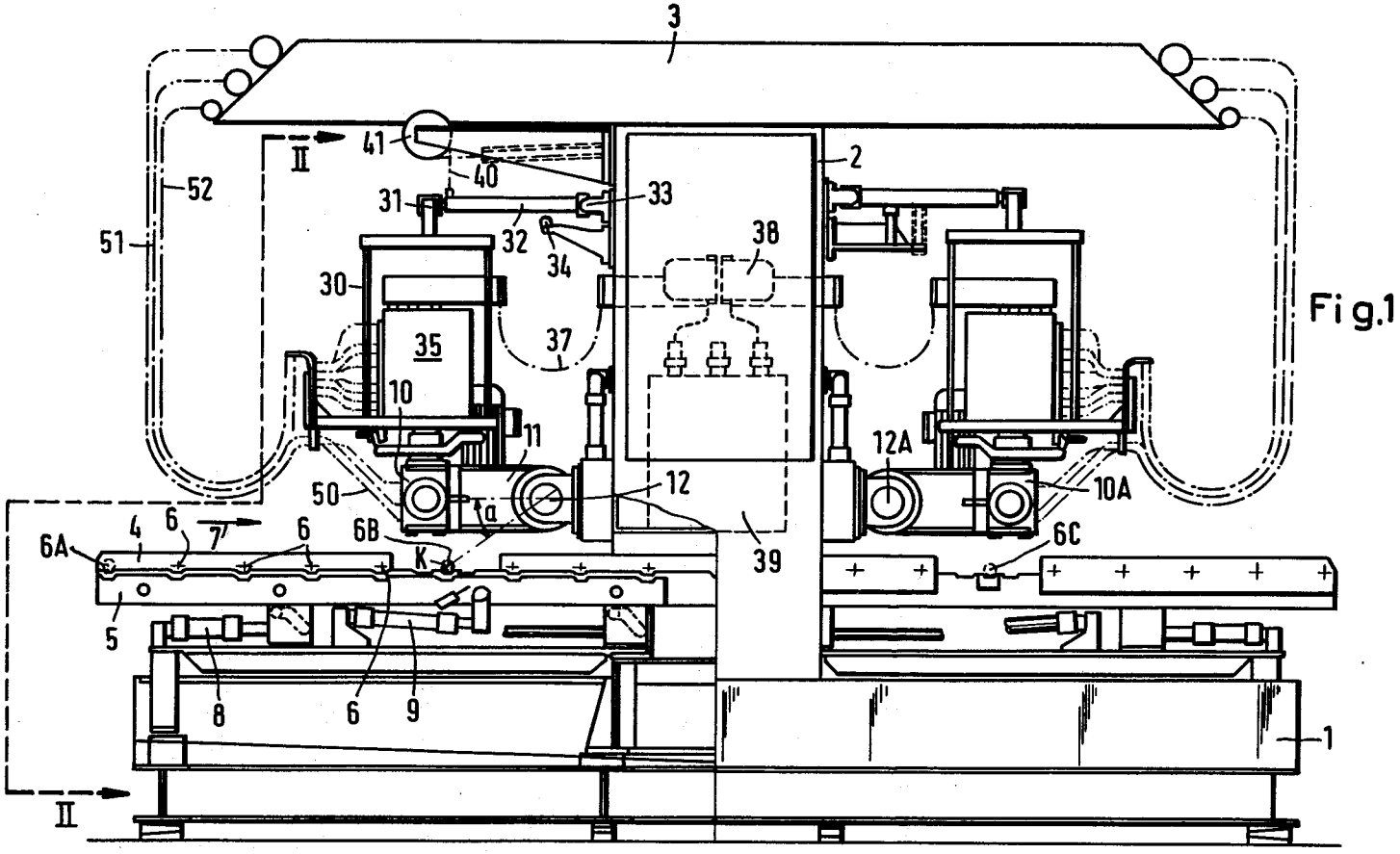
FIG. 1 shows a machine corresponding to the invention in side view.

In FIG. 1 base frame 1 of the machine is set on a foundation and mounts a vertically extending portal-like support 2 with a covering 3 disposed above it. The base frame 1 mounts a transportation means in the form of a lifter-conveyor consisting of a locally fixed solid beam system 4 with an assigned lifter system 5. The solid beam system 4 (cf. also FIG. 2) consists of two parallelly disposed beams 4 and 4A which are provided with pairs of bearings 6 longitudinally separated from one another. A pair of bearings 6A is disposed at the inlet of the lifter-conveyor to receive a horizontally disposed crankshaft which is inserted in the corresponding bearing pair of the two solid beams 4 and 4A. For placement on input bearings 6A, the crankshaft is lifted step by step by corresponding transportation movements of the lifter system 5, which consists of two parallelly disposed beams, and is then moved onto the next following bearing 6, in the direction of arrow 7. For this purpose, the lifter system 5 is moved via a corresponding mechanical gearing by means of hydraulic piston motors 8 and 9 in a known manner perpendicularly in relation to the plane of the solid beam system 4, 4A and parallel thereto on a closed transportation path of movement. After several transportation steps, the crankshaft K reaches the clamp-in position 6B disposed on the fixed beam system, from the starting position at bearings 6A. The numeral 10 designates a clamping arrangement swivelably mounted around rotational axis 12 on a lever arm 11, which arrangement is mounted rotatably around the bearings 13 and 14 in the frame 2 for movement through swiveling angle $\alpha$.

The clamping arrangement 10 consists of a chuck 20, the clamping jaws of which may be opened and closed hydraulically by means of a hydraulic piston motor 21. Opposite chuck 20, a casing 22 may be shifted by means of a hydraulic piston motor 23 toward chuck 20. The clamping arrangement 10 itself may be swivelled by means of the hydraulic piston motor 24 around rotational axis 12 and may be turned into a clamping in position in which the chuck 20 and the casing 22 grip on both sides of the shaft ends crankshaft K which is located in position 6B. By operating piston motor 23, shaft K may be gripped by chuck 20 and after that it may be clamped down by operation of the piston motor 21 in the chuck arrangement 20. Then, the unilaterally clamped in crankshaft is relieved of the pressure of the clamping casing 22 by operation of the motor 23, so that the shaft is clamped down unilaterally. In this operating phase, the crankshaft K is turned around its rotational axis and is aligned with its lifting bearing that is to be hardened so that the bearing will assume a suitable starting position for treatment by the inductor.

By operation of the motor 24 finally, the clamping arrangement 10 is lifted out of its clamping-in position into its operating position for which purpose the clamping arrangement 10 is turned by the angle $\alpha$ around its rotational axis 12.

The numeral 30 designates a linkage swingably mounted around rotational axis 31 which runs perpendicularly in relation to the plane of the drawing of FIG. 1, which linkage is articulated to a one-armed lever 32. The lever 32 is pivotably attached to frame 2 for rotation about axis 33 which runs perpendicularly to the plane of the drawing. The lever arm 32 rests on a stop 34 which can be adjusted in height.

Linkage 30 mounts a medium frequency transformer 35 and an inductor 36 which has the shape of a half shell inductor. The primary winding of the transformer 35 is connected via a flexible electric feed line 37, assigned relays 38 and capacitors 39 with a source of medium frequency current (not shown).

In the operating position of the clamping arrangement 10, an electric motor 25 turns (rotates) chuck 20 around the longitudinal axis of crankshaft K, as a result of which the latter is rotated around its longitudinal axis and the inductor heats the lifting bearing inductively.

Figure 2:
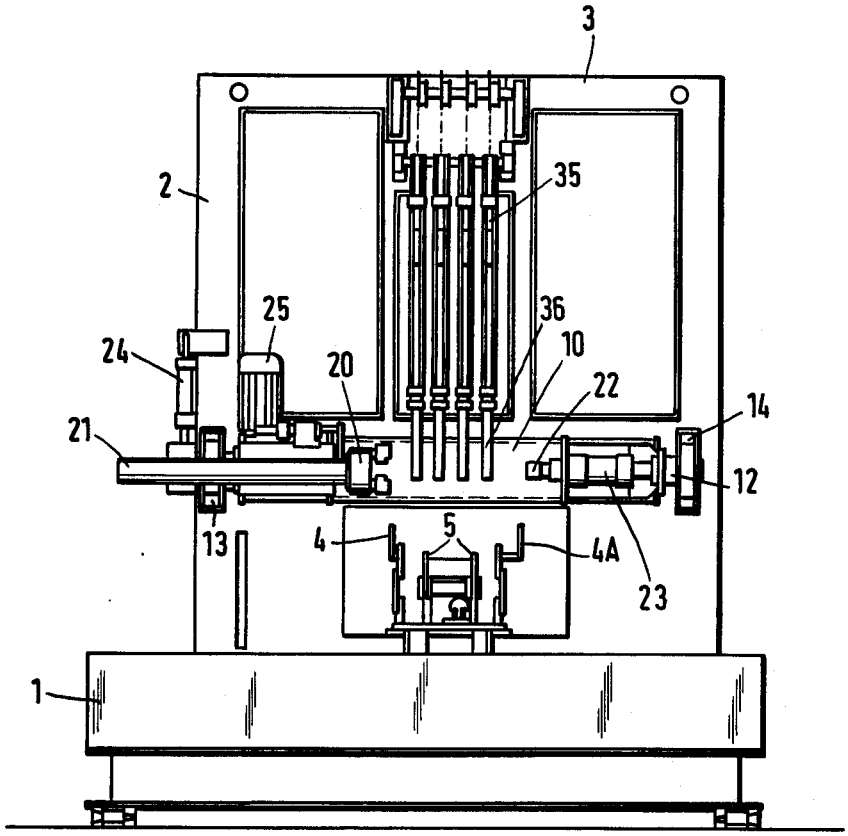
FIG. 2 shows the machine in end view in the direction II—II of FIG. 1.

Referring to FIG. 2, three additional transformers and inductors are disposed beside the transformer 35 and the inductor 36 connected firmly with the transformer, which likewise form separate construction units for the heating of additional lifting bearings of the crankshaft. Each of the inductor construction units is rotatably mounted around a further lever arm 32 so that it may be lifted from a pertinent stop 34, whereby the weight of the pertinent linkage 30, as a result of counter weights, etc., is relieved of its weight via a rope pulley 40, which engages by way of a roller 41 with arm 32.

The inductors 36 are additionally provided with shower arrangements in a manner known per se, which may be fed a quenching liquid by flexible lines 50. Flexible cool water pipes 51 and 52 feed the windings of the transformers and the windings of the inductor arrangements with cooling water, so that excess heat is eliminated from these construction parts.

The machine described hereby operates as follows. A crankshaft inserted, e.g., manually into the input bearing arrangement 6A is transported into the clamping down position 6B by means of the lifter-conveyer. After that, the clamping down arrangement 10 is lowered to the clamping down position and the workpiece K in the clamped down position is clamped down by means of the clamping arrangement. After that the crankshaft is turned into its first operating position and the clamping down arrangement 10 is transported around the rotational axis 12 into the pertinent operating position in which the inductors 36 rest on the pertinent lifting bearings of the crankshaft. After that, the motor 25 is again operated which turns the crankshaft around its longitudinal axis, whereby the inductors 36 participate in the pertinent rotational movement on the surfaces of the lifting bearings, while the linkage 30 swings around the rotational axis 31. Simultaneously, the linkage 30 is in a position to participate in the pertinent lifting movement by lifting the lever arm 32 off the stop 34 as it rides on the crankshaft. This lifting movement takes place free of the weight-forces originating from the weight of the transformers and the inductors or of the linkage 30, which forces are absorbed via the relief of the pulley 40 and roller 41.

During the rotation of the crankshaft around its longitudinal axis, the inductors are fed a medium frequency current which heats the running surfaces of the bearings of the crankshaft inductively. After sufficient heating, the running surfaces of the bearings are quenched by operation of the pertinent shower arrangements and the quenched crankshaft is again transferred into the clamping position 6B by lowering the clamping arrangement, and again to the transportation means by unclamping the workpiece, which transportation means transfers the workpiece into the second clamping position 6C to which analogously as described, a clamping, induction heating and quenching arrangement are assigned. The pertinent clamping arrangement 10A, in turn, is mounted swivelably in a rotational axis 12A and conveys the workpiece located in the clamping position 6C into an operating position in which pertinent inductors will heat the main bearing surface of the workpiece, and the assigned shower arrangements will subsequently quench the heated running surfaces of the bearing. After that, the workpiece is again moved back into the clamping position 6C and is conveyed by means of the transportation arrangement, disposed on the frame 1, and by means of an additional separate transportation arrangement (not shown) out of the area of the machine.

The invention is not limited to the embodiment shown. Thus, for example, the induction hardening arrangements for the main and the lifting bearings of the camshaft may be interchanged in the path of transportation of the conveying arrangement. The control and adjusting arrangements for the rhythmical operation of the machine have not been shown in detail. Thus, for example, a control arrangement belongs to the clamping down arrangement 10 of the machine which operates it by terminal bearing switches and permits holding the crankshaft K in certain clamping positions by operation of the motor 25 which transports the workpiece into certain angular positions. Many other changes and modifications to the above described embodiment of the invention can, of course, be made without departing from the scope of the invention, that scope being limited only by the scope of the appended claims.

What is claimed is:

1. An apparatus for the inductive hardening by quenching of the running surface of bearings of a crankshaft having a longitudinal axis comprising:

a machine frame;

clamping means mounted in said frame for movement around a horizontally disposed rotational axis including a clamp for gripping a crankshaft at a clamping position, such that said crankshaft is gripped with its longitudinal axis along said rotational axis and a lever arm connecting said clamp to said frame for swinging said crankshaft between said clamping position and a heating position;

means for rotating said crankshaft about its longitudinal axis while said clamp is gripping said crankshaft;

inductive heating means disposed above said clamping means and crankshaft in said heating position including at least one inductor mounted in a plane perpendicular to said horizontally disposed rotational axis for movement in all directions in said plane, said inductor resting on the surface of said bearings when said crankshaft is swung into said heating position, and means for feeding an AC current to said inductor for heating the running surface of the bearings;

means for feeding a liquid coolant for quenching the heated running surface; and means for transporting said crankshaft to said clamping position.

2. An apparatus as in claim 1, wherein said inductor is swingably mounted for movement about a rotational axis parallel to said horizontally disposed rotational axis of said clamping means and wherein said frame includes a vertically extending support and further including a further lever arm pivotably connected to said support at one end and connected swingably to said inductor at the other end and a stop below said further lever arm, said further lever arm being liftable from said stop.

3. An apparatus as in claim 2, including a linkage connecting said inductor to said further lever arm and mounting said coolant feeding means.

4. An apparatus as in claim 1, including a plurality of inductors for simultaneous heating of several running surfaces.

5. An apparatus as in claim 1, wherein said transporting means includes a pair of fixed beams and a pair of lifter beams.

6. An apparatus as in claim 1, including a second clamping means, inductive heating means, and coolant feeding means disposed on the path of said transporting means for subsequent heat treatment of a crankshaft.

* * * * *